US006332830B1

(12) United States Patent
Okamura et al.

(10) Patent No.: US 6,332,830 B1
(45) Date of Patent: Dec. 25, 2001

(54) POLISHING METHOD AND POLISHING DEVICE

(75) Inventors: Kouichi Okamura; Fumio Suzuki; Hisashi Masumura, all of Nishishirakawa (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 09/509,208

(22) PCT Filed: Jul. 29, 1999

(86) PCT No.: PCT/JP99/04062

§ 371 Date: Mar. 24, 2000

§ 102(e) Date: Mar. 24, 2000

(87) PCT Pub. No.: WO00/07771

PCT Pub. Date: Feb. 17, 2000

(30) Foreign Application Priority Data

Aug. 4, 1998 (JP) ..... 10-220573

(51) Int. Cl.[7] ..... B24B 1/00

(52) U.S. Cl. ..... 451/36; 451/288; 451/526; 451/41

(58) Field of Search ..... 451/36, 288, 526, 451/41, 287, 261, 262, 268

(56) References Cited

U.S. PATENT DOCUMENTS 5,584,750 * 12/1996 Ishida et al. ..... 451/288
5,704,827 * 1/1998 Nishi et al. ..... 451/41
5,904,609 * 5/1999 Fukuroda ..... 451/8
5,972,162 * 10/1999 Cesna ..... 451/41
5,975,986 * 11/1999 Allen ..... 451/288
5,997,390 * 12/1999 Hose ..... 451/261
6,206,769 * 3/2001 Walker ..... 451/288
6,213,855 * 4/2001 Natalico ..... 451/288

FOREIGN PATENT DOCUMENTS 0 845 328 A2 6/1998 (EP) .
U-61-175352 10/1986 (JP) .
A-5-237761 9/1993 (JP) .

* cited by examiner

*Primary Examiner*—Joseph J. Hail, III
*Assistant Examiner*—Daniel Shanley
(74) *Attorney, Agent, or Firm*—Oliff & Berridge, PLC

(57) ABSTRACT

A polishing method and a polishing apparatus that are for making contact pressure between a work and a polishing pad substantially uniform within surfaces to obtain a work having good quality. A turn table (2) is supported by a grooved surface of a turn table receiving member (3*b*), the grooved surface being provided with grooves (9*b*) in a straight direction, a work (W) is pressed against a polishing pad (8) adhered to the turn table (2) while flowing polishing slurry, and a polishing is carried out by rotating the work (W) and the turn table (2).

20 Claims, 4 Drawing Sheets

POLISHING METHOD AND POLISHING DEVICE

TECHNICAL FIELD

The present invention relates to a polishing method and a polishing apparatus for polishing (mirror polishing) works (for example, semiconductor wafers or the like), and more specifically to a turn table receiving member supporting a turn table of a polishing apparatus.

BACKGROUND ART

When a work is polished, generally, the polishing is carried out by pressing the work against a polishing pad adhered to a turn table while polishing slurry is flowed on the polishing pad and by rotating the work and the turn table.

A polishing apparatus used for the polishing has a turn table to which a polishing pad is adhered, a turn table receiving member having grooves and supporting the turn table by a grooved surface, a polishing slurry supplying means for supplying polishing slurry to the polishing pad, and a rotating means for rotating a work and the turn table.

Recently, for improving productivity, concretely, for reducing a time of apparatus stop when polishing pads are exchanged, a polishing apparatus in which a turn table is detachable has been used. With the polishing apparatus, while casting, stainless steel and ceramic having high strength are used for materials of the turn table and the turn table receiving member for heightening hardness of the polishing apparatus, grooves are formed in a turn table support surface of the turn table receiving member for easily detaching the turn table from the turn table receiving member.

However, during polishing with the polishing apparatus, the turn table receives a polishing load from the work, while the turn table receives a reaction force from the turn table receiving member. The reaction force becomes contact pressure between the polishing pad and the work. In this case, if grooves are formed in the turn table receiving member, thereby the turn table receives the reaction force from non-groove portions of the turn table receiving member, but does not receive the reaction force from grooved portions. As a result, the contact pressure between the polishing pad and the work becomes non-uniform within a surface of the work, thereby a polishing rate of the work becomes non-uniform within the surface to form minute waviness on the work surface.

With the preceding developed art, as shown in FIG. 6, for example, in a case that concentric circle-like grooves 9*d* are provided in a turn table receiving member 3*d* and that a rotation center of the turn table receiving member 3*d* and a rotation center of a work coincide with each other, strong portions and weak portions of contact pressure against a polishing pad generate concentrically and alternately about the rotation center of the work. In this case, the polishing rate of the work changes according to the contact pressure. Thus, with the work, portions corresponding to the non-groove portions are more polished, while portions corresponding to the grooved portions are less polished, thereby, as shown in FIG. 8, concentric circle-like waviness is formed on the work W. That is, for example, irregularities of about not more than 0.1 $\mu$m are formed periodically on the work. Such a phenomenon is observed when a pattern of the grooves 9*d* of the turn table receiving member 3*d* is concentric circle-like or spiral.

Further, even if the rotation center of the turn table receiving member and the rotation center of the work do not coincide with each other, that is, the rotation center of the work is eccentric from the rotation center of the turn table receiving member, when concentric circle-like grooves are provided in the turn table receiving member, the contact pressure to the polishing pad in the vicinity of the rotation center of the work becomes either constantly strong or constantly weak, thereby there is a problem that a polishing degree is changed between a central portion of the work and a peripheral portion thereof.

The present invention was developed in view of the above-described problems. An object of the present invention is to provide a polishing method and a polishing apparatus for making contact pressure between a work and a polishing pad substantially uniform within surfaces to obtain a work having good quality.

DISCLOSURE OF THE INVENTION

According to the first aspect of the present invention, a polishing method according to the present invention comprises the steps of supporting a turn table by a grooved surface of a turn table receiving member, the grooved surface being provided with a plurality of grooves in a straight direction, pressing a work against a polishing pad adhered to the turn table while flowing polishing slurry, and carrying out a polishing by rotating the work and the turn table.

According to the polishing method, the plurality of straight line-like grooves are provided in the turn table receiving member, thereby loci of the grooves in the turn table receiving member against respective portions of the rotating work show complex loci, so that the contact pressure between the polishing pad and the work is substantially averaged. Thus, the contact pressure within the surface of the work from the polishing pad is also averaged, thereby a work can be obtained that has good quality.

According to the second aspect of the present invention, a polishing apparatus according to the present invention comprises a turn table to which a polishing pad is adhered, a turn table receiving member supporting the turn table by a grooved surface in which a groove is formed, a polishing slurry supplying unit for supplying polishing slurry to the polishing pad, and a rotating mechanism for rotating a work and the turn table, wherein the groove is provided in the receiving member in a straight direction.

According to the polishing apparatus, a plurality of straight line-like grooves are provided in the turn table receiving member, thereby loci of the grooves in the turn table receiving member against respective portions of the rotating work show complex loci. As a result, the contact pressure of the turn table receiving member is substantially averaged. Thus, the contact pressure within the surface of the work from the polishing pad is also averaged, thereby a work can be obtained that has good quality.

With the polishing method and the polishing apparatus, the grooves can be provided in parallel with each other. The grooves can have a grid-like or radial configuration. It is preferable that a rotation center of the turn table receiving member and a rotation center of the work are different from each other. Thereby, the contact pressure between the polishing pad and the work is substantially averaged.

The work can include a semiconductor wafer. In a case of a work, such as a semiconductor wafer that is extremely thin and is required extremely high flatness, an effect obtained by applying the method or the apparatus according to the present invention is particularly remarkable.

It is preferable that a plurality of grooves are provided as the groove and that widths of the grooves are within 3 to 15 mm, spacings of the grooves are within 10 to 100 mm and depths of the grooves are within 1 to 10 mm, respectively. Particularly, when a semiconductor wafer is polished with the present invention, good flatness can be obtained when the grooves are within the ranges, further, detachment of the turn table from the turn table receiving member becomes easy.

PREFERRED EMBODIMENT OF THE INVENTION

Figure 1:
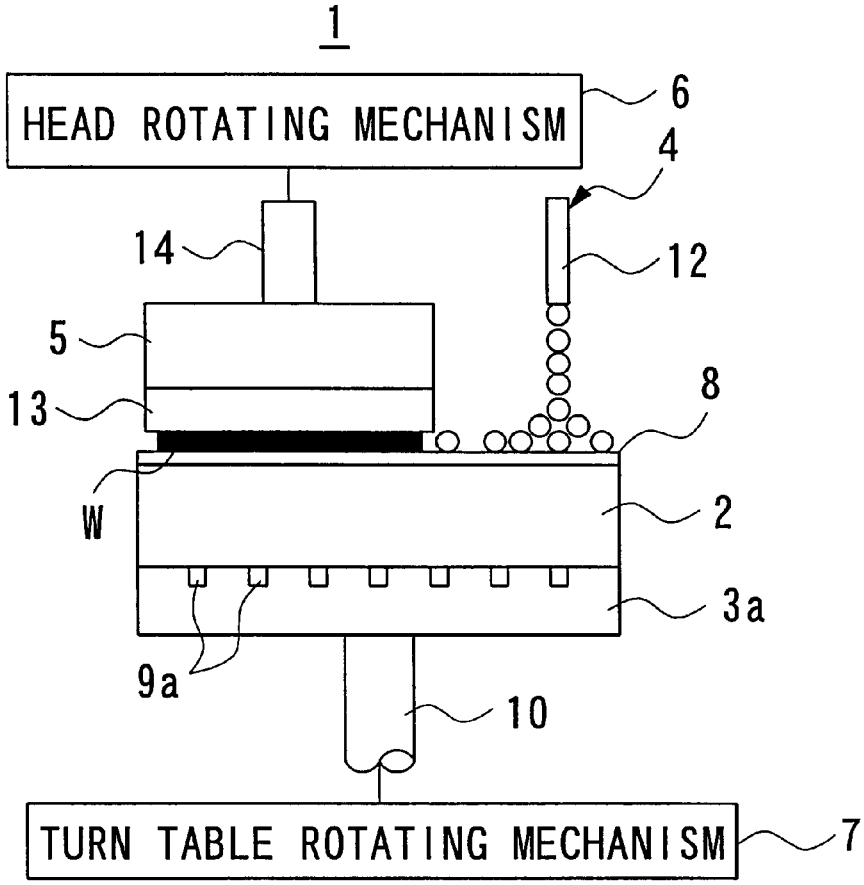
FIG. 1 is a schematic structural view of a polishing apparatus relating to the first embodiment of the present invention.

FIG. 1 is a schematic view of a polishing apparatus relating to the first embodiment of the present invention. The polishing apparatus 1 has a turn table 2, a turn table receiving member 3, a polishing slurry supplying unit 4, a top ring 5, a head rotating mechanism 6 and a turn table rotating mechanism 7.

To the turn table 2, a polishing pad 8 is adhered. The turn table 2 is supported attachably and detachably by the turn table receiving member 3*a*. The reason for constituting attachably and detachably is to make exchange for the polishing pad 8 easy by detaching integrally the turn table 2 and the polishing pad 8 in exchanging the polishing pad 8. In this case, mounting of the turn table 2 to the turn table receiving member 3*a* is carried out with an exclusive jig.

Figure 2:
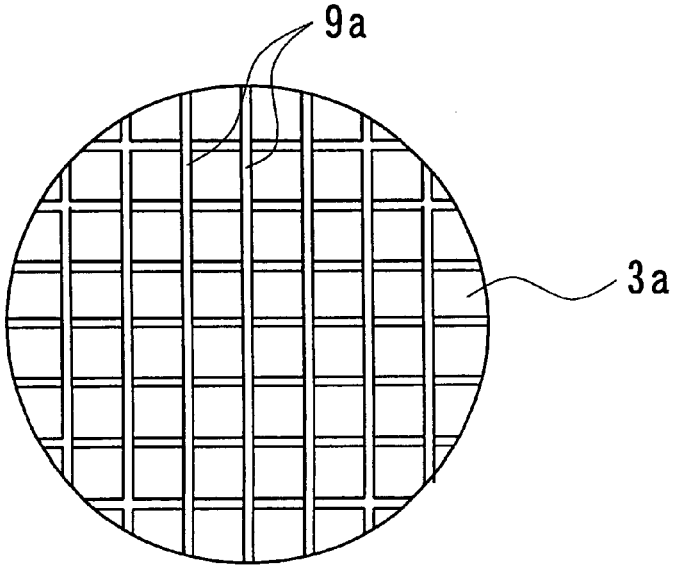
FIG. 2 is a plan view of a turn table receiving member of the polishing apparatus relating to the first embodiment.

As shown in FIG. 2, grid-like grooves 9*a* are provided in an upper surface of the turn table receiving member 3*a*. The grooves 9*a* in this case may be wavy lines, if these are provided in a grid as a whole. The grooves 9*a* are formed in the surface of the turn table receiving member 3*a* for supplying the grooves 9*a* with fluid, for example, water in detaching the turn table 2 from the turn table receiving member 3*a* to easily detach the turn table 2 by the water pressure. An axis 10 of the turn table receiving member 3*a* is connected to a motor (not shown) through a reduction gear. The reduction gear and the motor constitute the turn table rotating mechanism 7.

A rotation center of the turn table receiving member 3*a* is different from a rotation center of a work W. Thereby, contact pressure between the polishing pad 8 and the work W is as substantially averaged as possible.

The polishing slurry supplying unit 4 is provided with a nozzle 12 connected with a polishing slurry store tank (not shown). The polishing slurry is supplied to a rubbing portion between the work W and the polishing pad 8 from the nozzle 12.

The top ring 5 is for pressing the work W against the polishing pad 8, however, not to directly press it, but to press it through a plate 13. In this case, the work W is adhered to the plate 13 with a wax method or a waxless method. An axis 14 of the top ring 5 is connected to a motor (not shown) through a reduction gear. The reduction gear and the motor constitute the head rotating mechanism 6.

Next, a polishing method of the work W by the polishing apparatus 1 will be explained.

At first, the plate 13 to which the work W is adhered is placed at an under side of the top ring 5 to bring the work W into contact with the polishing pad 8. Then, the top ring 5 is lowered to press the work W against the polishing pad 8 through the plate 13. While driving the head rotating mechanism 6 and the turn table rotating mechanism 7, the polishing slurry is supplied from the nozzle 12 of the polishing slurry supplying unit 4 to polish the work W. After the polishing is completed, the top ring 5 is raised and the plate 13 is taken out.

According to the polishing apparatus 1 and the polishing method carried out by the polishing apparatus 1, a following effect can be obtained.

That is, the grooves 9*a* are provided in the turn table receiving member 3*a*, thereby when the work W is pressed against the polishing pad 8, the reaction forces that the turn table 2 is received from the grooved portions and the non-groove portions of the turn table receiving member 3*a* are different. However, the grooves 9*a* are grid-like, so that transferred portions from the grooved portions and the non-groove portions of the turn table receiving member 3*a* to the turn table 2 are uniformly contacted each portion of the rotating work W through the polishing pad 8. Thus, the contact pressure within the surface of the work W against the turn table 2 is averaged, so that no deviated load acts on the work W, thereby good quality can be obtained.

Figure 3:
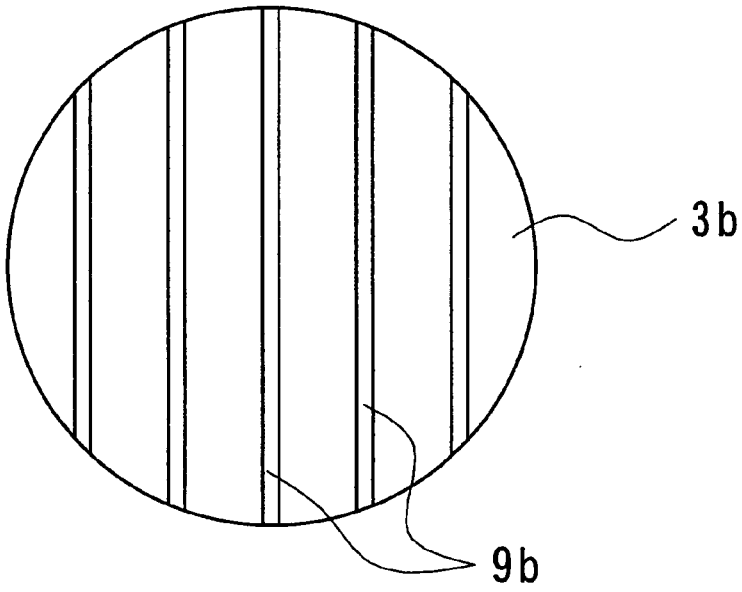
FIG. 3 is a plan view of a turn table receiving member of another polishing apparatus relating to the second embodiment of the present invention.

FIG. 3 shows a turn table receiving member 3*b* of a polishing apparatus relating to the second embodiment, where straight line-like grooves 9*b* are formed in parallel. In this case, if the grooves 9*b* are provided in a straight line direction as a whole, the grooves 9*b* may be wavy lines. Spacings between the grooves and the number of the grooves are not especially limited, however, for detaching the turn table 2, it is preferable that not less than 3 straight line-like grooves are formed in approximately the same spacings and parallel over the whole turn table.

According to the polishing apparatus, the same effect as of the polishing apparatus 1 according to the first embodiment can be obtained.

Figure 4:
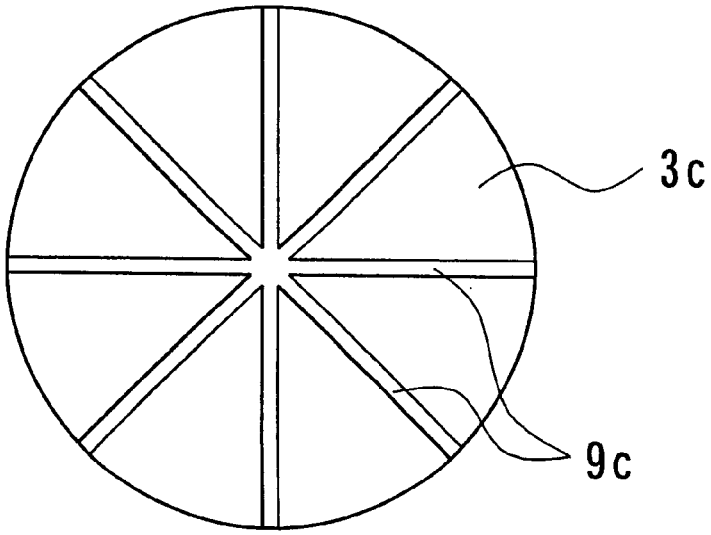
FIG. 4 is a plan view of a turn table receiving member of another polishing apparatus relating to the third embodiment of the present invention.

FIG. 4 shows a turn table receiving member 3*c* of a polishing apparatus relating to the third embodiment, where radial grooves 9*c* are provided. The grooves 9*c* in this case may be wavy lines if it is provided radially as a whole.

According to the polishing apparatus, the same effect as of the polishing apparatus 1 according to the first embodiment can be obtained.

Next, a preferable pattern of the grooves in the turn table receiving member will be explained.

1. Widths of the grooves: 3 mm to 15 mm

The turn table does not receive the stress from the grooved portions of the turn table receiving member, and the turn table receives the stress only from the non-groove portions. The difference of the stress received by the turn table causes formation of the waviness in the surface of the turn table. In this case, if the widths of the grooves exceed 15 mm, waviness having large wavelength is formed in the surface of the turn table, which influences the flatness. On the other hand, when it is less than 3 mm, even if the water is supplied to the grooves in the turn table receiving member in detaching the turn table, required pressure can not be obtained, so that it is difficult to detach the turn table from the turn table receiving member.

2. Spacings between the grooves: 10 mm to 100 mm

If the spacings between the grooves exceed 100 mm, the detachment of the turn table becomes difficult. On the other hand, if it is below 10 mm, the surface of the turn table waves finely and largely to influence the flatness.

Figure 5:
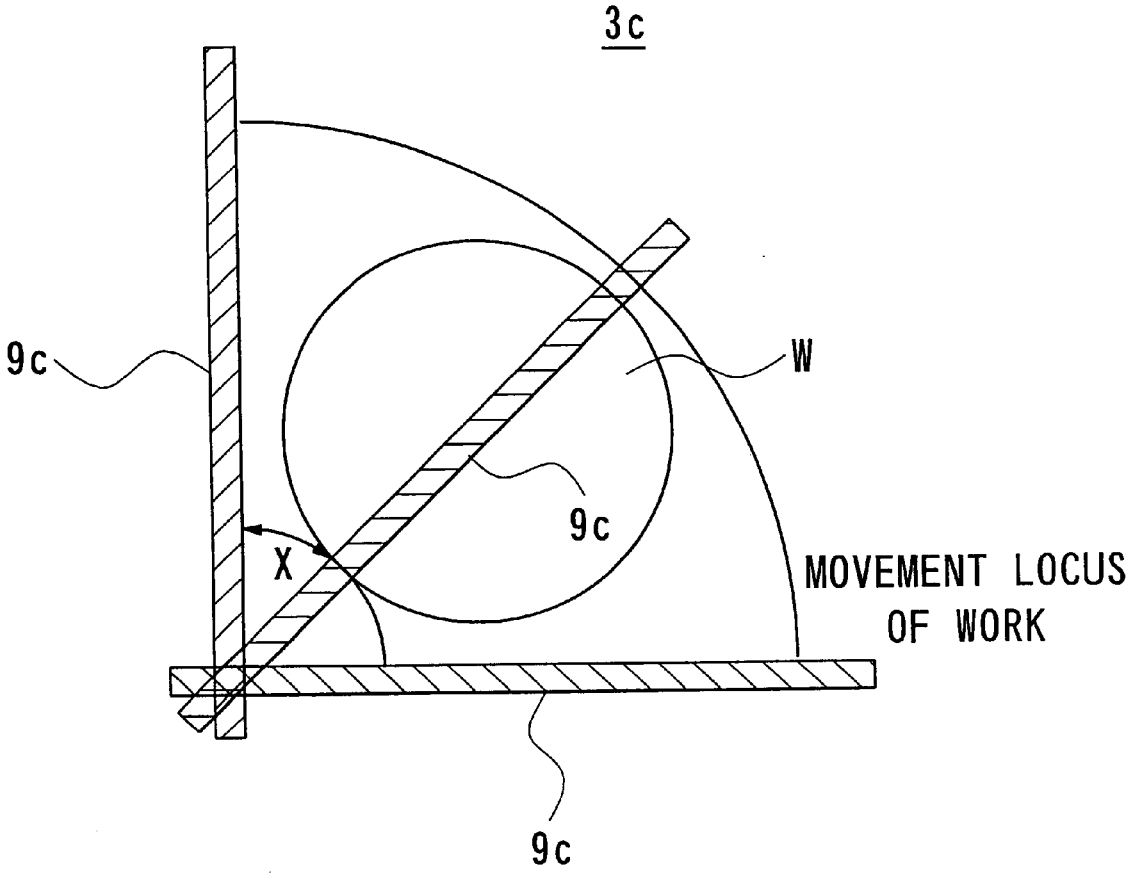
FIG. 5 is a view for explaining a suitable groove pattern of the turn table receiving member of FIG. 4.

When the grooves in the turn table receiving member 3*c* are provided radially, it is preferable that the rotation center of the turn table receiving member 3*c* and furthermore of the turn table and the rotation center of the work are different, besides the work is polished at the eccentric position of the turn table. In this case, as shown in FIG. 5, it is preferable that a circular arc length X between the most inner portion of a movement locus of the work W to the turn table receiving member 3*c* (precisely, the polishing pad 8) and an intersection of two adjacent grooves 9*c* is at least 10 mm.

3. Depths of the grooves: 1 mm to 10 mm

If the depths of the grooves exceed 10 mm, the hardness of the turn table receiving member lowers to influence the flatness. On the other hand, if it is below 1 mm, it is difficult to supply the grooves in the turn table receiving member with the water in detaching the turn table and is difficult to detach the turn table.

(Example of an experiment)

Figure 6:
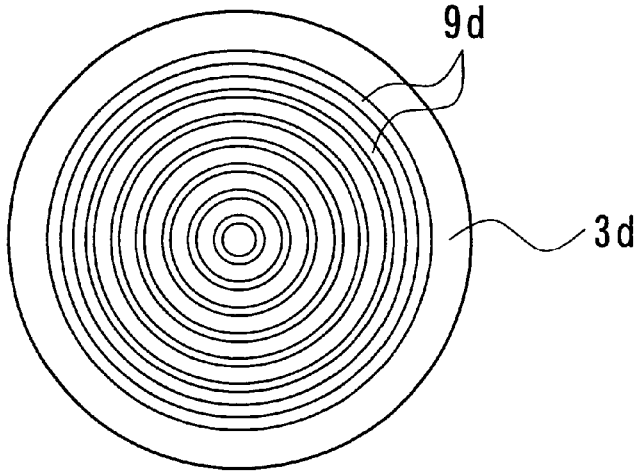
FIG. 6 is a plan view of a turn table receiving member of the polishing apparatus according to the preceding developed art.

In the experiment, a polishing is carried out by using the turn table receiving member 3*a* in which the grid-like grooves 9*a* as shown in FIG. 2 are provided. In addition, for comparing an effect to that, a polishing of a work (an article to be polished) is carried out by using the turn table receiving member 3*d* in which the concentric circle-like grooves 9*d* are provided according to the preceding developed art as shown in FIG. 6.

1. Conditions (1) Article to be polished

In the first example, for the article to be polished, an etched wafer which was a single crystal silicon wafer (thickness of 735 $\mu$m) grown with the Czochralski method and which was a p-type, and had crystal orientation <100> and 200 mmϕ was prepared.

(2) Polishing pad

A polishing pad that was an unwoven cloth type and had hardness 80 (ascar C hardness: conform to JISK6301) was used.

(3) Polishing slurry

Colloidal silica polishing slurry (pH=10.5) was used.

(4) Polishing load

The work was pressed against the polishing pad by the top ring with the polishing load of 250 g/cm$^2$.

(5) Entire polishing stock removal

The amount of removal, that is, the entire polishing stock removal with the polishing was 12 $\mu$m.

(6) Turn table

A turn table made of SiC and having a thickness of 30 mm and a diameter of 700 mmϕ was used.

(7) Turn table receiving member

It was made of ceramic, and widths of grooves were 10 mm, spacings thereof were 30 mm, and depths of the grooves were 3 mm.

2. Polishing Method

The turn table was attached to the turn table receiving member. With a center of the turn table receiving member and a center of the work 200 mm apart, the work was polished with a single wafer processing. Rotation rates of the work and the turn table were at 40 rpm, respectively. Further, the polishing was carried out with fixing the work while reciprocating the turn table within ±10 mm.

3. Result

Figure 7:
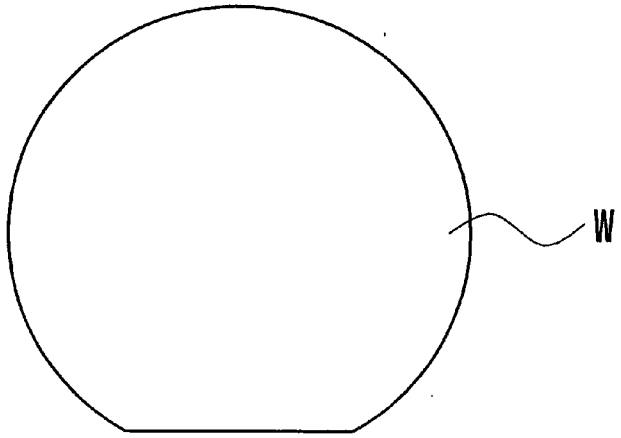
FIG. 7 is a view showing a polished surface of a work when the work is polished with the turn table receiving member of FIG. 2.
Figure 8:
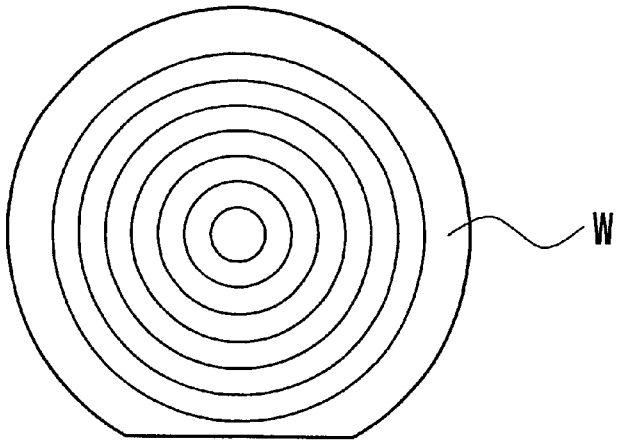
FIG. 8 is a view showing a polished surface of a work when the work is polished with the turn table receiving member of FIG. 6.

When the turn table receiving member 3*a* in which the grid-like grooves 9*a* as shown in FIG. 2 were provided was used, as shown in FIG. 7, a specific pattern was not observed on a magic mirror image after the polishing, so that it was confirmed that good quality was obtained. On the other hand, when the turn table receiving member 3*d* in which the concentric circle-like grooves 9*d* as shown in FIG. 6 were provided was used, it was confirmed that concentric circle-like patterns, as shown in FIG. 8, were generated on a magic mirror image after the polishing The embodiments according to the present invention are explained, however, needless to say, the present invention is not limited to the embodiments, and various modifications may be made within the scope of the invention. For example, in the above-described examples, the polishing of a semiconductor wafer is mainly explained, however, of course the present invention can be applied to a polishing of thin plates, such as glass substrates for liquid crystal panel, quartz glass substrates for photomask, magnetic disc substrates or other substrates other than semiconductor wafers.

Industrial Applicability

According to the present invention, a polishing is carried out by supporting a turn table by a grooved surface of a turn table receiving member, the grooved surface being provided with a groove extending in a straight direction, pressing a work against a polishing pad adhered to the turn table while flowing polishing slurry, and rotating the work and the turn table, thereby a work having good quality can be obtained. Further, exchange of the turn table is easy. Therefore, the polishing method and the polishing apparatus according to the present invention suit particularly the polishing for various thin plate products, such as semiconductor wafers, glass substrates for liquid crystal panel, quartz glass substrates for photomask, magnetic disc substrates or other substrates.

What is claimed is:

1. A polishing method comprising the steps of:

supporting a turn table by a grooved surface of a turn table receiving member, the grooved surface being provided with a plurality of grooves in a straight direction;

pressing a work against a polishing pad adhered to the turn table while flowing polishing slurry; and carrying out a polishing by rotating the work and the turn table.

2. The polishing method as claimed in claim 1, wherein the grooves are provided in parallel with each other.

3. The polishing method as claimed in claim 2, wherein widths of the grooves are within 3 to 15 mm, spacings of the grooves are within 10 to 100 mm and depths of the grooves are within 1 to 10 mm, respectively.

4. The polishing method as claimed in claim 1, wherein the grooves are provided in a grid.

5. The polishing method as claimed in claim 1, wherein the grooves are provided radially.

6. The polishing method as claimed in claim 5, wherein widths of the grooves are within 3 to 15 mm, spacings of the grooves are within 10 to 100 mm and depths of the grooves are within 1 to 10 mm, respectively.

7. The polishing method as claimed in claim 1, wherein a rotation center of the turn table receiving member and a rotation center of the work are different from each other.

8. The polishing method as claimed in claim 1, wherein widths of the grooves are within 3 to 15 mm, spacings of the grooves are within 10 to 100 mm and depths of the grooves are within 1 to 10 mm, respectively.

9. The polishing method as claimed in claim 1, wherein the work includes a semiconductor wafer.

10. The polishing method as claimed in claim 4, wherein widths of the grooves are within 3 to 15 mm, spacings of the grooves are within 10 to 100 mm and depths of the grooves are within 1 to 10 mm, respectively.

11. A polishing apparatus comprising:

a turn table to which a polishing pad is adhered;

a turn table receiving member supporting the turn table by a grooved surface in which grooves are formed;

a polishing slurry supplying unit for supplying polishing slurry to the polishing pad; and a rotating mechanism for rotating a work and the turn table, wherein the grooves are formed in the grooved surface of the receiving member in a straight direction.

12. The polishing apparatus as claimed in claim 11, wherein the grooves are formed parallel to each other.

13. The polishing apparatus as claimed in claim 11, wherein the grooves are formed in a grid.

14. The polishing apparatus as claimed in claim 11, wherein the grooves are formed radially.

15. The polishing apparatus as claimed in claim 11, wherein a rotation center of the turn table receiving member and a rotation center of the work are different from each other.

16. The polishing apparatus as claimed in claim 11, wherein widths of the grooves are within 3 to 15 mm, spacings of the grooves are within 10 to 100 mm and depths of the grooves are within 1 to 10 mm, respectively.

17. The polishing apparatus as claimed in claim 12, wherein widths of the grooves are within 3 to 15 mm, spacings of the grooves are within 10 to 100 mm and depths of the grooves are within 1 to 10 mm, respectively.

18. The polishing apparatus as claimed in claim 13, wherein widths of the grooves are within 3 to 15 mm, spacings of the grooves are within 10 to 100 mm and depths of the grooves are within 1 to 10 mm, respectively.

19. The polishing apparatus as claimed in claim 14, wherein widths of the grooves are within 3 to 15 mm, spacings of the grooves are within 10 to 100 mm and depths of the grooves are within 1 to 10 mm, respectively.

20. The polishing apparatus as claimed in claim 11, wherein the work includes a semiconductor wafer.

* * * * *